United States Patent [19]

Adachi

[11] 3,949,639

[45] Apr. 13, 1976

[54] VOLTAGE CONTROLLED TYPE ELECTRONIC MUSICAL INSTRUMENT

[75] Inventor: Takeshi Adachi, Hamamatsu, Japan

[73] Assignee: Nippon Gakki Seizo Kabushiki Kaisha, Hamamatsu, Japan

[22] Filed: Dec. 30, 1974

[21] Appl. No.: 537,201

[30] Foreign Application Priority Data

Jan. 10, 1974 Japan ..... 49-6468[U]

[52] U.S. Cl. ..... 84/1.27; 84/1.1; 84/DIG. 2; 84/DIG. 20

[51] Int. Cl.[2] ..... G10H 1/02; G10H 5/02

[58] Field of Search ..... 84/1.01, 1.09–1.13, 84/1.19–1.21, 1.24, 1.26, 1.27, DIG. 2, DIG. 20

[56] References Cited

UNITED STATES PATENTS

| | | | |
|---|---|---|---|
| 3,250,843 | 5/1966 | Jenny | 84/1.09 |
| 3,439,106 | 4/1969 | Goodale | 84/1.27 |
| 3,557,295 | 1/1971 | Adachi | 84/1.19 X |
| 3,570,357 | 3/1971 | Adachi | 84/1.26 |
| 3,609,203 | 9/1971 | Adachi | 84/1.01 |
| 3,614,288 | 10/1971 | Amano | 84/1.21 |
| 3,666,875 | 5/1972 | Ranzato | 84/1.13 |
| 3,708,603 | 1/1973 | Keagle et al. | 84/1.11 |
| 3,801,721 | 4/1974 | Bunger | 84/1.19 |
| 3,819,843 | 6/1974 | Okamoto | 84/1.1 |
| 3,828,110 | 8/1974 | Colin | 84/1.01 |
| 3,835,237 | 9/1974 | Adachi | 84/1.24 |
| 3,848,092 | 11/1974 | Shamma | 84/1.27 X |
| R27,983 | 4/1974 | Stearns | 84/1.01 |

*Primary Examiner*—L. T. Hix
*Assistant Examiner*—Stanley J. Witkowski
*Attorney, Agent, or Firm*—Flynn & Frishauf

[57] ABSTRACT

This invention relates to a voltage controlled type electronic musical instrument comprising a keyboard section for generating a pitch determining voltage signal and a trigger signal upon key operation, a voltage controlled tone signal generating circuit including a voltage controlled oscillator, voltage controlled filter and voltage controlled amplifier for generating a tone signal in response to the pitch determining voltage signal and control wave generating circuits responsive to the trigger signal for generating control waves coupled to the voltage controlled oscillator, voltage controlled filter and voltage controlled amplifier. The pitch determining voltage signal is coupled to the voltage controlled amplifier so as to control the gain thereof, thereby decreasing the volume of musical sounds at higher frequency from that of musical sounds at lower frequency.

5 Claims, 6 Drawing Figures

FIG. 3A
FIG. 3B
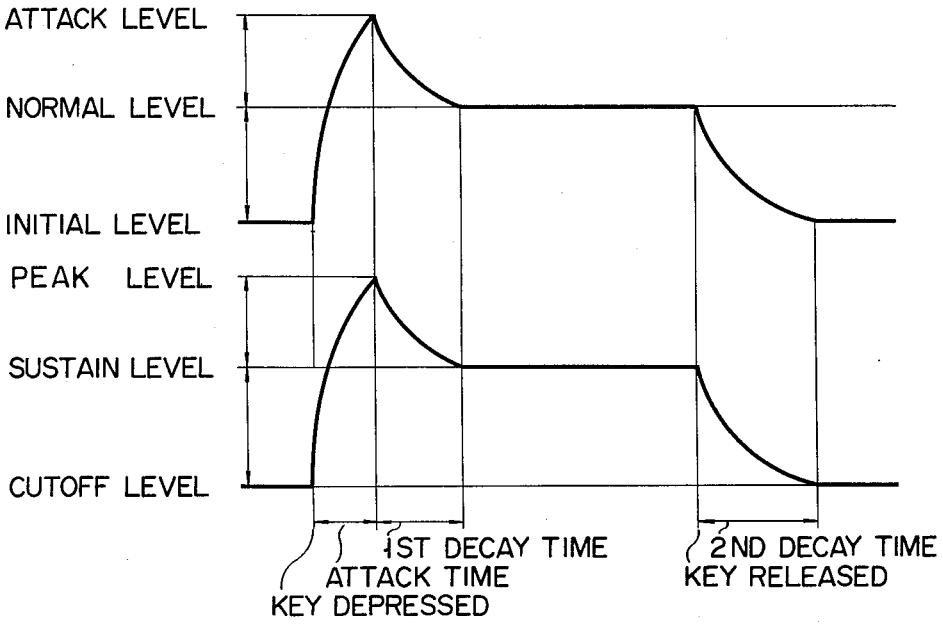
FIG. 5
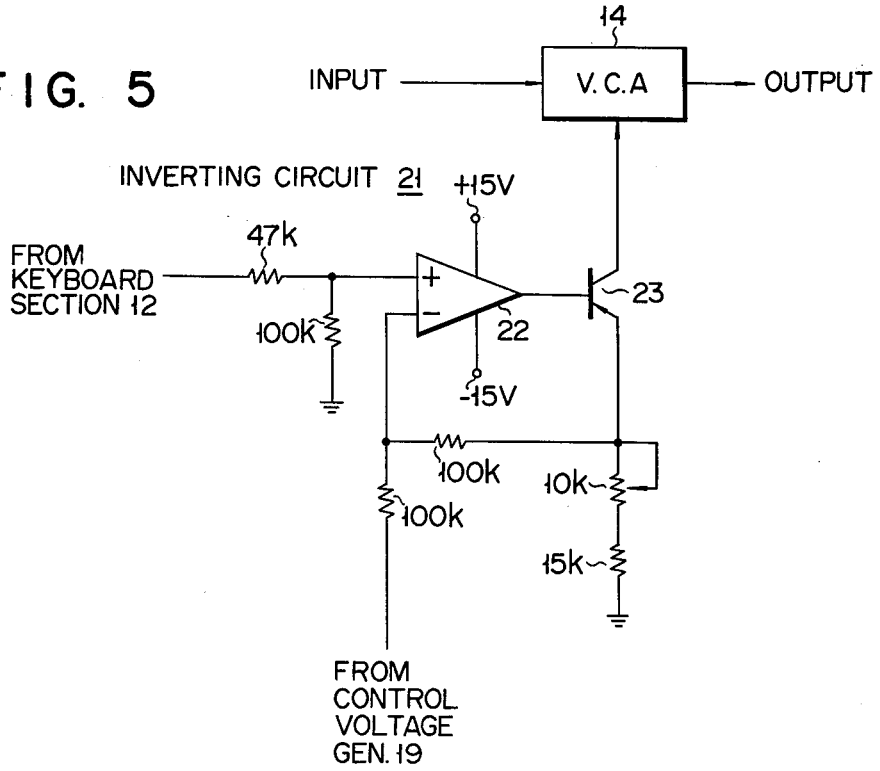

VOLTAGE CONTROLLED TYPE ELECTRONIC MUSICAL INSTRUMENT

BACKGROUND OF THE INVENTION

This invention relates to an electronic musical instrument and more particularly to a keyboard type electronic musical instrument including a voltage controlled tone signal generating means.

With a prior art electronic musical instrument, tone generators give forth upon key operation a tone signal having a pitch frequency corresponding to the note of the operated key. The generated tone signal is conducted to a tone-coloring filter having preselected frequency characteristics to be changed into a musical tone signal for actuating a loudspeaker. With the electronic musical instrument wherein tone signals are electrically produced, the amplitude-pitch characteristics of tone signals are adjusted flat over the keyboard compass. However, the human ear has nonflat frequency characteristics and has particularly sharp sensitivity over the range of 1 to several kHz units. Therefore, musical sounds obtained by tone signals having flat frequency characteristics are not received as such by a listener over the entire tone pitch range.

With natural musical instruments, higher pitch tones generally have a smaller volume than lower pitch tones. Such characteristics are not attained by an electronic musical instrument.

SUMMARY OF THE INVENTION

It is accordingly the object of this invention to provide an electronic musical instrument capable of controlling the amplitude level of a musical tone signal according to the note of an operated key.

The electronic musical instrument of this invention is a voltage controlled type and includes a keyboard section for generating upon key operation a pitch determining voltage signal whose voltage value is a function of the pitch or note of an operated key and a trigger signal indicating the key operation.

A pitch-determining voltage signal from the keyboard section is delivered to a voltage controlled tone signal generator to provide a tone signal. The trigger signal from the keyboard section is supplied to a control wave (voltage signal) generator to give forth a control wave whose voltage level varies as a function of time.

The control wave is conducted to the voltage controlled tone signal generating means so as to transiently modify the frequency, tone color and envelope of a generated tone signal according to the wave shape of the controls voltage signal. This invention is characterized in that the amplitude level of the generated tone signal is controlled in inverse proportion to the note (frequency) of operated key.

BRIEF DESCRIPTION OF THE DRAWING

FIG. 3A represents the waveform of a control voltage signal impressed on the voltage controlled oscillator and voltage controlled filter of FIG. 1;

FIG. 3B shows the waveform of a control voltage signal supplied to the voltage controlled amplifier of FIG. 1;

FIG. 5 is a circuit diagram of the inverting circuit of FIG. 1.

DETAILED DESCRIPTION OF THE INVENTION

Figure 1:
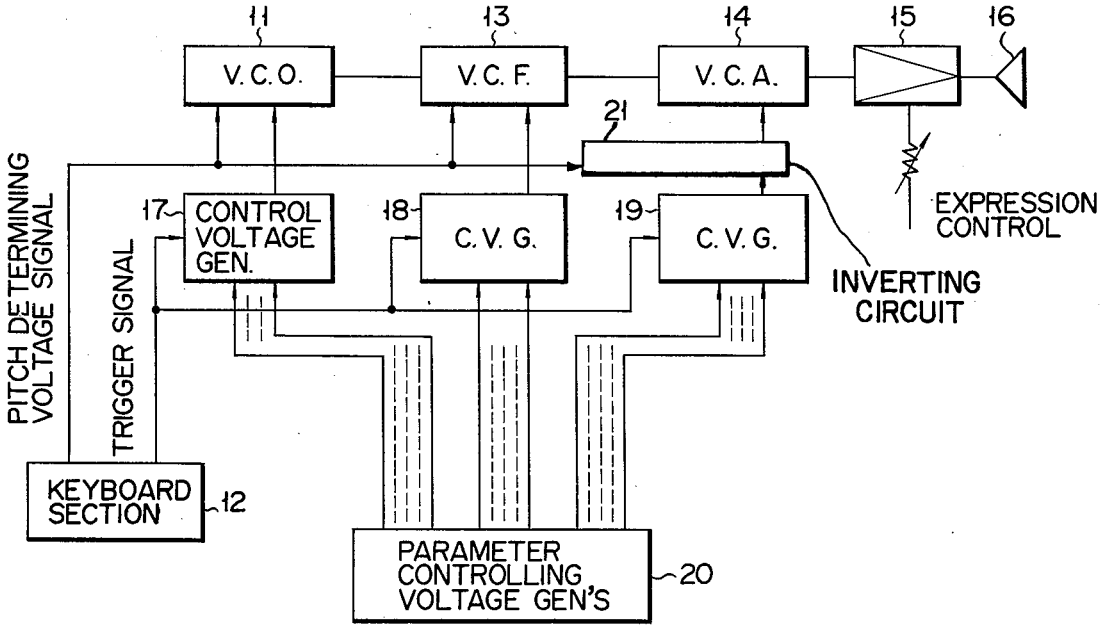
FIG. 1 is a block diagram of an electronic musical instrument according to an embodiment of this invention.

FIG. 1 shows one embodiment of this invention. In the drawing a reference numeral 11 shows a voltage controlled oscillator (hereinafter referred to as VCO). VCO 11 generates, in response to a pitch determining voltage signal obtained by key operation at a keyboard section 12, a tone signal having a pitch (frequency) for the note of an operated key. The tone signal from VCO 11 is coupled to a voltage controlled filter (hereinafter referred to as VCF), where a tone color is imparted to the tone signal, and then to a voltage controlled amplifier 14 (hereinafter referred to as VCA). The output of VCA 14 is fed through an output amplifier 15 to a loudspeaker 16. Control voltage generators 17 to 19 are provided to control the pitch, tone color and tone volume of the tone signal and coupled to VCO 11, VCF 13 and VCA 14, respectively. Control voltage generators 17 to 19 generate, in response to a trigger signal obtained by the key actuation at the keyboard section 12 which continues from key depression to key release, control voltage signals which are coupled to VCO 11, VCF 13 and VCA 14 respectively. VCO 11 is adapted to transiently vary according to the waveform of the control voltage signal from the control voltage generator 17, the frequency of the tone signal corresponding to the operated key; VCF 13 is caused to have a cutoff frequency appropriate to the tone signal from the VCO 11 in response to the pitch determining voltage signal and has this cutoff frequency characteristic transiently varied according to the waveform of the control voltage signal from the control voltage generator 18; and VCA 14 has its amplification gain controlled according to the waveform of the control voltage signal from the control voltage generator 19 to vary the envelope of an output tone signal from the VCF 13.

FIGS. 3A and 3B show the graphical representation of control voltage waveforms obtained from the control voltage generators 17 to 19. FIG. 3A shows the control voltage waveform applied to VCO 11 and VCF 13 and FIG. 3B shows the control voltage waveform applied to VCA 14. When the key is depressed the voltage waveform of FIG. 3A rises, during an attack time or rise time, from an initial level to an attack level and then decays, during a first decay time, from the attack level to a normal level. The normal level is continued until the key is released. After release of the key, the voltage waveform further decays, during a second decay time, from the normal level to the initial level.

When the voltage waveform of FIG. 3A is fed to VCO 11, a tone signal is so controlled that its frequency abruptly varies during the key depression time from the initial level frequency which is somewhat lower than the normal level frequency to the attack level frequency which is somewhat higher than the normal level frequency. Thereafter, the tone signal frequency approaches, during the first decay time, to the normal level frequency which is the correct frequency for the pitch determining voltage from the keyboard section 12. After lapse of the first decay time, the tone signal frequency becomes equal to the normal level frequency. After release of the key, the tone signal frequency decays, during the second decay time, from the normal level frequency to the initial level frequency. That is, the tone signal frequency obtained from VCO 11 is modified according to the voltage waveform which varies as a function of time.

When the voltage waveform of FIG. 3A is supplied to VCF 13, the cutoff frequency of the voltage controlled filter is controlled in accordance with the waveform and, consequently, the tone color of the tone signal is transiently modified.

The voltage waveform showing in FIG. 3B rises, upon depression of the key, from a cutoff level to a peak level. After lapse of the attack time, the voltage waveform is returned, during the first decay time, to a sustain level, and the sustain level is continued until the key is released. After release of the key, the voltage waveform decays, during the second decay time, from the sustain level to the cutoff level. When the voltage waveform of FIG. 3B is supplied to VCA 14, such an envelope as is shown in the waveform of FIG. 3B is imparted to the tone signal. When no voltage waveform of FIG. 3B is applied to VCA 14, VCA 14 is in the cutoff state. It will be understood that VCA 14 is operated as a tone keyer.

With the electronic musical instrument of this invention, the above mentioned VCO 11, VCF 13 and VCA 14 and control voltage generators 17 to 19 may be of the known configurations. The control voltage generators 17 to 19 may be so designed as to cause various parameters of the waveform to be controlled by parameter controlling voltages. To this end, parameter controlling voltage generators 20 is additionally provided. In this case, the generators 20 may be provided with a power source and parameter controlling potentiometers connected across the power source. The sliders of the potentiometers should preferably be placed on the control panel of an electronic musical instrument so as to enable a player freely to control various parameters of the waveform of the control voltages. The magnitude of each parameter controlling voltage is adjusted by the potentiometer slider. Such an example was invented by Hiyoshi et al and has been disclosed in U.S. Application Ser. No. 457,646, filed Apr. 3, 1974 and assigned to the same assignee as the present application.

Figure 2:
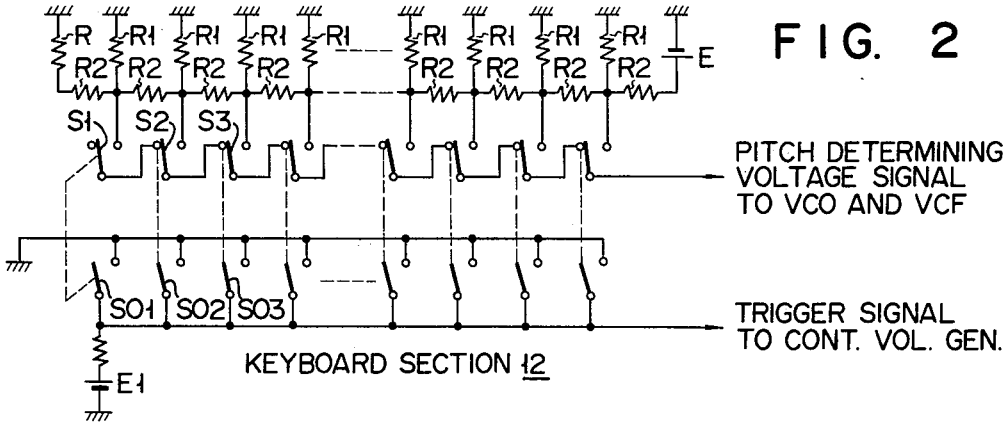
FIG. 2 is a circuit arrangement of the keyboard section of FIG. 1.

FIG. 2 shows the arrangement of the keyboard section 12 from which a pitch determining voltage signal is supplied to VCO 11. The voltage of a power source E is divided by a voltage dividing circuit arrangement including resistors R1 and R2, and the normally open fixed contacts of key switches S1, S2, S3, . . . are connected to the respective voltage dividing points. The movable contacts of the respective key switches are connected to the normally closed fixed contacts of the adjacent key switches. When a plurality of keys are depressed at a time, a voltage of the voltage dividing point connected to the key switch actuated by the key corresponding to the highest note of actuated keys and having a value decisive of the note is fed to VCO 11 in the key switch arrangement shown. There are further provided key switches S01, S02, S03 . . . which are ganged with the key switches S01, S02, S03 . . . respectively. When the key is operated, a trigger signal which is a negative going voltage change from a power source voltage E1 to 0 volts is supplied to the control voltage generators 17 to 19. The control voltage generators 17 to 19 start the formation of control voltages upon receipt of the trigger signal.

Figure 4:
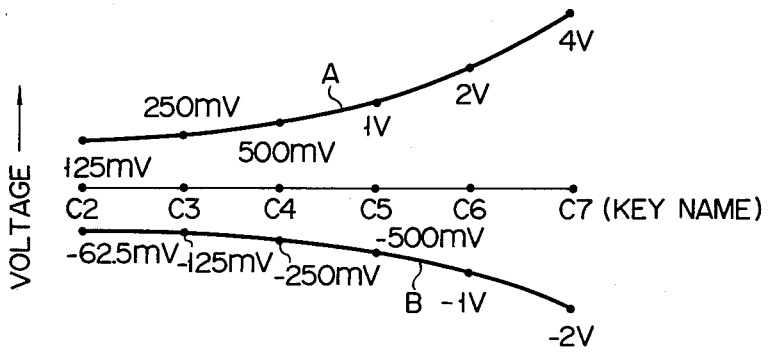
FIG. 4 shows the voltage relationship between output signals (pitch determining voltage signal) from the keyboard section and the inverting circuit of FIG. 1 with respect to key names.

As the frequencies of tones show an exponential function with respect to the note names, the voltage value of the pitch determining voltage signal given forth by the keyboard section 12 should also vary, as illustrated by the curve A of FIG. 4, exponentially with respect to the note names.

According to this invention, the pitch determining voltage signal delivered from the keyboard section 12 is supplied to VCA 14 through an inverting circuit 21 the output characteristic of which has an inverse relationship as shown by the curve B of FIG. 4 to that of the keyboard section 11.

Therefore, in VCA 14 supplied with a control voltage signal from the control voltage generator 19 having a waveform as shown in FIG. 3B and with an inverter output having frequency characteristics indicated by the curve B of FIG. 4, a gain for the tone signal is controlled according to the inverter output. Namely, the output signal level of VCA 14 conversely more decreases as the frequency increases.

As apparent from the control wave of FIG. 3B, VCA 14 of FIG. 1 is so designed as to cause a gain to increase progressively as the voltage value of the control voltage signal increases. For this reason, in the embodiment of FIG. 1, a pitch determining voltage signal is applied to VCA 14 through the inverting circuit 21. However, VCA 14 may be so arranged as to cause a gain conversely to increase progressively as a value of control voltage decreases. In this case, a pitch determining voltage signal may be applied to VCA 14 without passing through the inverting circuit 21.

FIG. 5 is a circuit diagram suitable for the inverting circuit 21 using an operational amplifier 22. The pitch determining voltage signal of the keyboard section 12 and the control voltage signal of the control voltage generator 19 are applied to the positive and negative input terminals of the operational amplifier 22, respectively. The output terminal of the operational amplifier 22 is coupled to the control terminal of the VCA 14 through a transistor 23. As the operational amplifier, the $\mu$PC 741HC operational amplifier (Fairchild) may be used. Further, as the VCA 14 supplied with the output signal of the inverting circuit 21, the CA 3080 amplifier (RCA) which is of a current controlled type may be used.

What is claimed is:

1. An electronic musical instrument comprising:

a keyboard section including keys and means for generating in response to key operation a pitch determining voltage signal having a voltage representing a note of the operated key;

voltage controlled tone signal generating means for generating in response to the pitch determining voltage signal from said keyboard section a tone signal having a frequency determined by said pitch determining voltage signal;

sound reproducing means coupled to the output of said voltage controlled tone signal generating means; and means coupled between said voltage controlled tone signal generating means and said sound reproducing means and responsive to the pitch determining voltage signal from said keyboard section for controlling the amplitude of the tone signal from said voltage controlled tone signal generating means in such a manner that the amplitude of a tone signal of a higher pitch frequency becomes smaller than that of a tone signal of a lower pitch frequency.

2. An electronic musical instrument according to claim 1 wherein said last-mentioned means comprises a voltage controlled amplifier.

3. An electronic musical instrument comprising:

a keyboard section including keys and means for generating in response to the key actuation a pitch determining voltage signal having a voltage representing a note of the actuated key and a trigger signal indicative of the actuation of the key;

voltage controlled tone signal generating means including a voltage controlled oscillator responsive to the pitch determining voltage signal from said keyboard section for generating a tone signal having a frequency determined by said pitch determining voltage signal, a voltage controlled filter coupled to said voltage controlled oscillator, and a voltage controlled amplifier coupled to said voltage controlled filter and providing an output signal;

control voltage generating means responsive to the trigger signal from said keyboard section for generating control voltage waves which are coupled to said voltage controlled oscillator, voltage controlled filter and voltage controlled amplifier;

sound reproducing means coupled to receive said output signal from said voltage controlled tone signal generating means; and means for coupling the pitch determining voltage signal from said keyboad section to said voltage controlled amplifier to control the gain of said voltage controlled amplifier in such a manner that the amplitude of a tone signal of a higher pitch frequency becomes smaller than that of a tone signal of a lower pitch frequency.

4. An electronic musical instrument according to claim 3 wherein said last-mentioned means comprises an inverting circuit for producing an output signal which is coupled to said voltage controlled amplifier to control the gain thereof, the polarity of the output signal being inverse to that of the pitch determining voltage signal from said keyboard section, and the amplitude of the output signal being proportional to that of the pitch determining voltage signal.

5. An electronic musical instrument according to claim 3 wherein said last-mentioned means comprises an operational amplifier having positive and negative input terminals and an output terminal, said positive and negative input terminals being connected to receive the pitch determining voltage signal from said keyboard section and the control voltage wave from said control voltage generating means, respectively, and said output terminal being coupled to said voltage controlled amplifier.

* * * * *